US005878617A

United States Patent [19]

Parker

[11] Patent Number: 5,878,617

[45] Date of Patent: Mar. 9, 1999

[54] PNEUMATIC DECKING CRIMPER

[76] Inventor: James R. Parker, P.O. Box 42033-103, Phoenix, Ariz. 85080-2033

[21] Appl. No.: 961,162

[22] Filed: Oct. 30, 1997

[51] Int. Cl.[6] ..... B21J 9/18; B21D 7/00

[52] U.S. Cl. ..... 72/409.12; 72/451; 72/453.15

[58] Field of Search ..... 72/407, 409.12, 72/450, 451, 453.16, 453.15

[56] References Cited

U.S. PATENT DOCUMENTS

| | | | |
|---|---|---|---|
| 1,743,209 | 1/1930 | Groehn . | |
| 3,877,280 | 4/1975 | Cornell . | |
| 4,353,240 | 10/1982 | Undin et al. | 72/409.12 |
| 4,531,397 | 7/1985 | Pratt | 72/409.12 |
| 4,558,584 | 12/1985 | Myers | 72/453.16 |
| 4,893,493 | 1/1990 | Jacques . | |
| 4,989,438 | 2/1991 | Simon . | |
| 5,381,686 | 1/1995 | Thorup . | |
| 5,509,291 | 4/1996 | Nilsson . | |

FOREIGN PATENT DOCUMENTS

| | | | |
|---|---|---|---|
| 2423226 | 11/1975 | Germany | 72/453.16 |

*Primary Examiner*—David Jones

*Attorney, Agent, or Firm*—John D. Titus; Bryan Cave, LLP

[57] ABSTRACT

A power assisted crimping tool is disclosed particularly suited to crimping and dimpling of structural steel decking and roofing panels together. The invention comprises a frame supporting a pair of jaws which are opened and closed by means of a toggle linkage that is driven by an operator-controlled pneumatic cylinder. The input pivot of the toggle linkage is constrained to move linearly by means of a cross head formed in the frame which, in turn, causes the jaws to move in unison rather than one jaw moving against the other. According to one embodiment, the jaws are provided with a plurality of punch and die sets disposed in opposite orientations, such that as the decking or roofing panel joint is crimped by the jaws, the punch and die sets raise a plurality of dimples having alternating orientations. The alternating dimples provide a substantial increase in the lateral resistance (shear strength) of the crimped seam, thereby obviating the need to additionally weld or screw the seam to provide the necessary shear strength.

3 Claims, 3 Drawing Sheets

PNEUMATIC DECKING CRIMPER

BACKGROUND OF THE INVENTION

The present invention relations to hand tools for forming crimp joints in structural steel decking and roofing commonly used in large commercial construction for example as subflooring for poured concrete floors or as roofing for large industrial buildings. Structural steel decking is typically manufactured in thicknesses ranging from 22 gauge to 16 gauge or more. The decking generally is supplied to the building site in panels ranging in size from 3 feet by 15 feet to about 3 feet by 35 feet. Longitudinal ribs, typically hat sections or flat-bottomed vee sections of from 1½ to 3 inches in depth are formed in the panels to increase the section modulus of the panels. The individual panels are typically provided with one edge having an exposed upward "male" lip. The opposite edge is provided with a female inverted "U" shaped lip. The individual panels are joined together by placing the female lip over the male lip and crimping, welding, or screwing the seam at periodic intervals. In many applications, the joints must secure the panels together so as not only to prevent one panel from lifting off the other, but also to prevent the panels from shifting laterally along the seam (along the x-axis as shown in FIG. 1). By holding the panels securely enough to prevent lateral shifting, the assembled decking adds considerable membrane strength to the assembled building. Given the inherent weakness of crimped joints to lateral shifting, typically where high membrane strength was required, welding or screwing the seam has been specified.

A prior art method for crimping steel decking comprises use of a hand-operated tool shown in FIG. 1, known as the 601 SEAM LOCKER distributed by Miramar Specialties of Ventura Calif. The prior art apparatus comprises a compound-lever press in which the operator moves the handles apart to provide the force to crimp the panels together. An optional button punch is provided to upset a portion of the seam to provide some lateral stiffness. Since the apparatus comprises merely a compound lever arrangement, however, it provides a linear multiplication of the force exerted by the operator on the handles. As can be appreciated from the foregoing, hand crimping of thousands of seams is a laborious task and, given the inevitability of operator fatigue, an inherently unreliable method for providing seams having the uniformity necessary to compete with welded and screwed joints in the high stress applications.

Various portable power tools have been developed for setting rivets, crimping sheet metal trusses, and for other applications. For example, U.S. Pat. No. 1,743,209 to Groehn discloses a fastener setting device comprising a toggle-actuated jaw and anvil adapted for setting rivets, particularly in the construction of automobile bodies. U.S. Pat. No. 3,877,280 to Cornell discloses a hand operated power assisted punch and die for crimping sheet metal studs and joists together to form a modular wall panel. U.S. Pat. No. 4,989,438 to Simon discloses a hand operated power assisted punch and crimp for attaching comer bead to exterior comers in sheetrock or gypsum board walls. What is needed, and what the prior art lacks is a power assisted punch/crimping tool having the features of the present invention.

SUMMARY OF THE INVENTION

The present invention provides a power assisted crimping tool particularly suited to crimping and dimpling of structural steel decking and roofing panels together. The invention comprises a frame supporting a pair of jaws which are opened and closed by means of a toggle linkage having that is driven by an operator-controlled pneumatic cylinder. The input pivot of the toggle linkage is constrained to move linearly by means of a cross head formed in the frame, which, in turn causes the jaws to move in unison rather than one jaw moving against the other. According to one embodiment, the jaws are provided with a plurality of punch and die sets disposed in opposite orientations, such that as the decking or roofing panel joint is crimped by the jaws, the punch and die sets raise a plurality of dimples having alternating orientations. The alternating dimples provide a substantial increase in the lateral resistance (shear strenght) of the crimped seam, thereby obviating the need to additionally weld or screw the seam to provide the necessary shear strength.

BRIEF DESCRIPTION OF THE DRAWING

The present invention will be better understood from a reading of the following detailed description, taken in conjunction with the accompanying drawing figures in which like references designate like elements and, in which.

DETAILED DESCRIPTION

Figure 1:
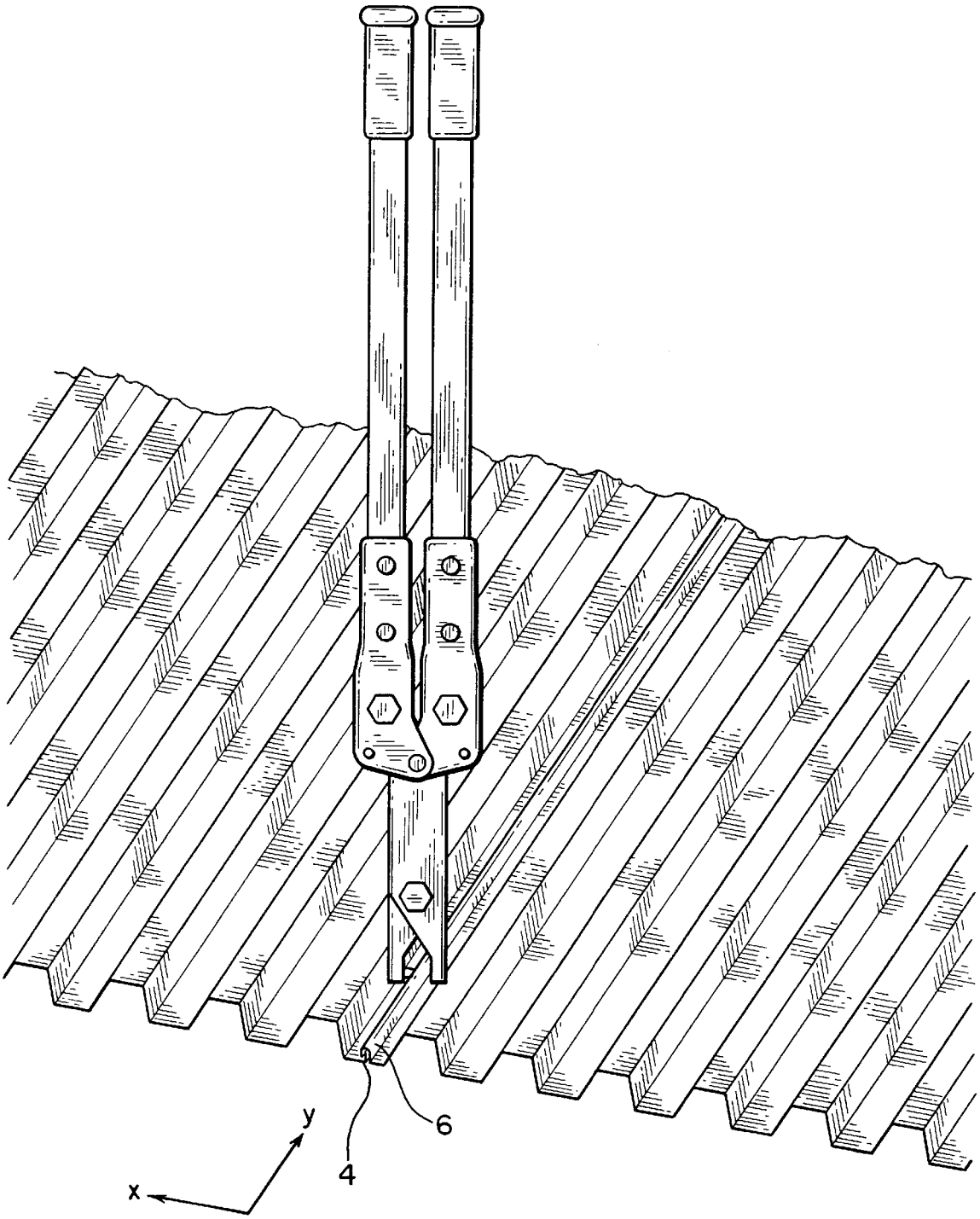
FIG. 1 (PRIOR ART)
FIG. 1 is a prior art crimping tool for use with steel decking and roofing.

The drawing figures are intended to illustrate the general manner of construction and are not to scale. In the description and in the claims the terms left, right, front and back and the like are used for descriptive purposes. However, it is understood that the embodiment of the invention described herein is capable of operation in other orientations than is shown and the terms so used are only for the purpose of describing relative positions and are interchangeable under appropriate circumstances.

The present invention relations to hand tools for forming crimp joints in structural steel decking and roofing commonly used in large commercial construction for example as subflooring for poured concrete floors or as roofing for large industrial buildings. As shown in FIG. 1, the individual decking or roofing panels are typically provided with one edge having an exposed upward "male" lip 4. The opposite edge is provided with an inverted "U" shaped female lip 6. The individual panels are typically joined together by placing the female lip over the male lip and welding, screwing or crimping the seam at periodic intervals. A prior art method of crimping the seam comprises use of a crimping tool known as the 601 SEAM LOCKER in which the user positions the jaws of the tool over the joint and by pulling the handles of the tool apart exerts a crimping force on the seam.

Figure 2:
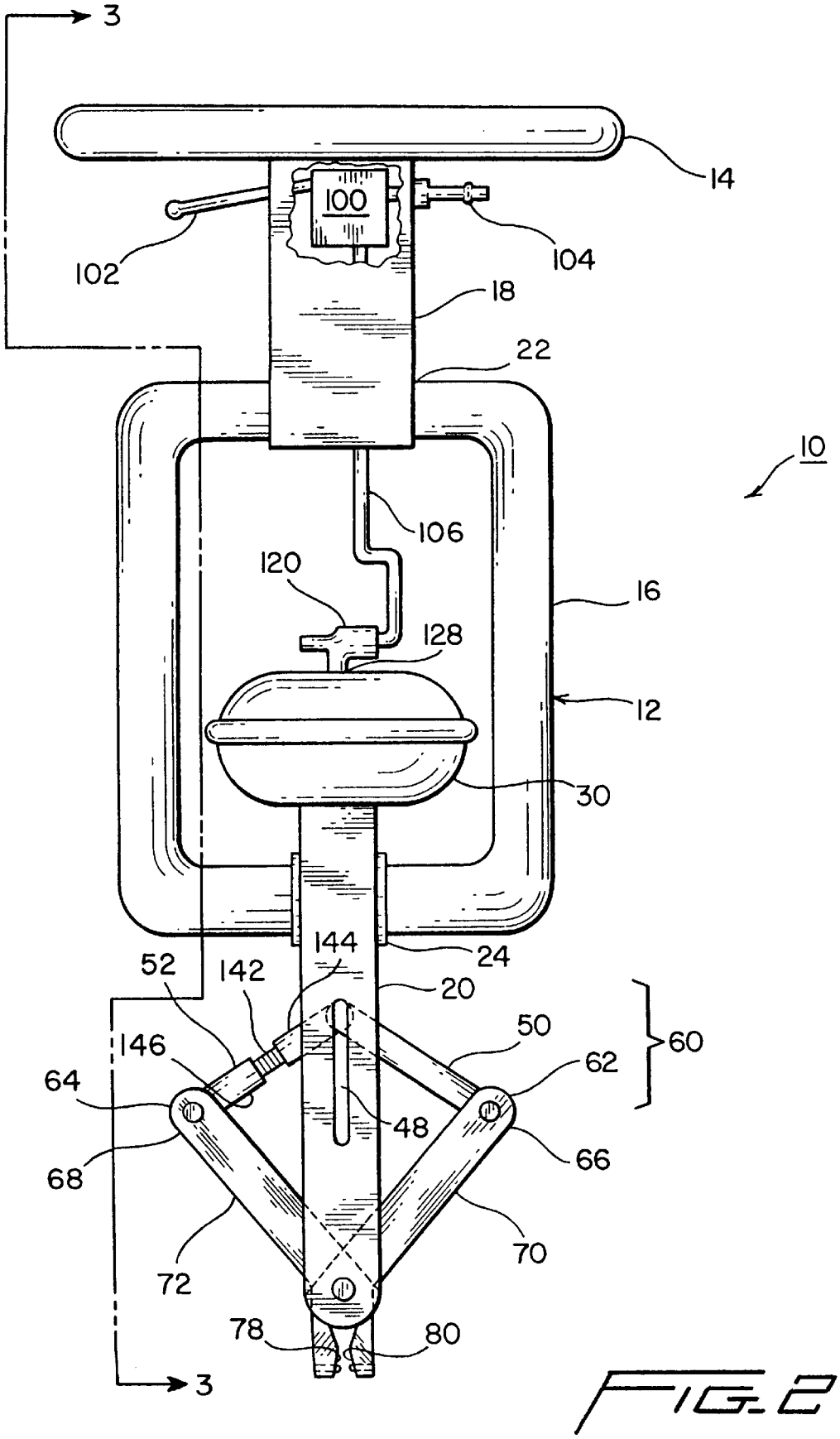
FIG. 2 is a side plan view of an illustrative pneumatic decking crimping apparatus incorporating features of the present invention.
Figure 3:
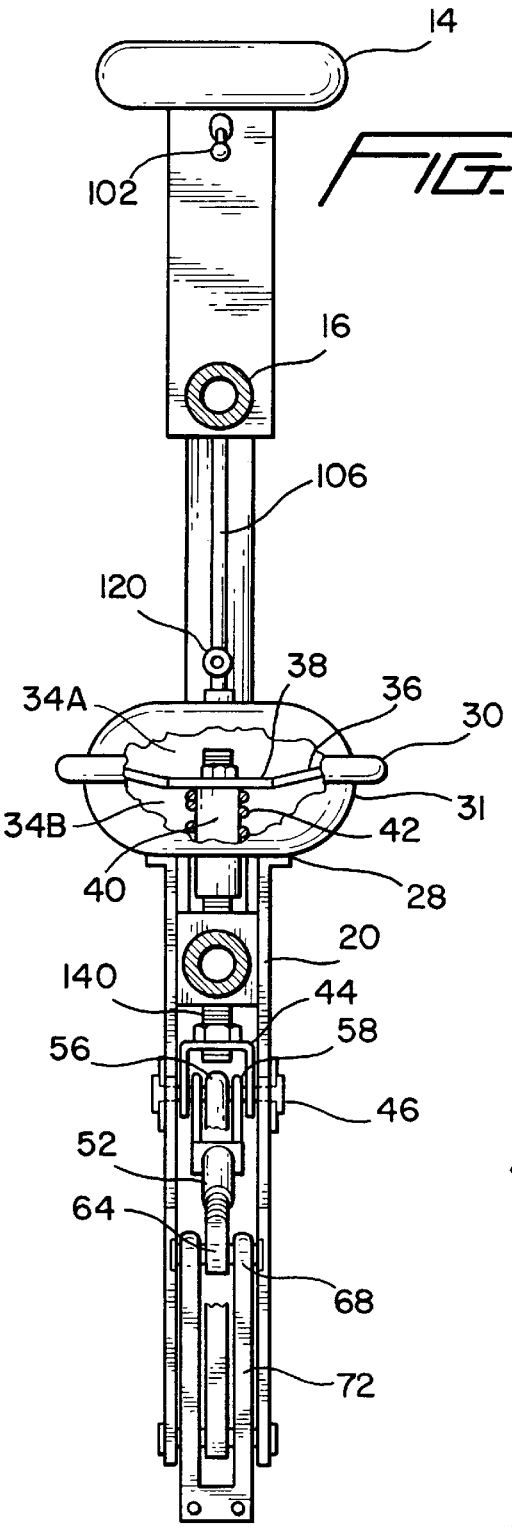
FIG. 3 is a partial cross section view of the apparatus of FIG. 2 taken along line 3—3.

Referring to FIGS. 2 and 3, an illustrative embodiment of the present invention comprises a tool 10 comprising a frame 12 having a handle 14 adapted to be grasped by a user at about waist level so that the lower extreme of tool 10 is at about foot level. The central section 16 of frame 12 comprises a rectangular frame constructed of hollow tubing which supports an upper extension 18, and a lower extension 20. Upper extension 18 is constructed of a single piece of rectangular tubing welded to the upper surface 22 of central section 16, or alternatively, upper extension 18 may be constructed of individual plates welded together to form a rectangular tube. Lower extension 20 is formed of two parallel plates welded to a spacer 24 which, in turn, is welded to central section 16.

Referring to FIG. 2, a pneumatic cylinder 30 is attached to the upper edge 28 of lower extension 20. Pneumatic cylinder 30 may comprise a piston inside a bore or other conventional pneumatically actuated linear motor. Preferably pneumatic cylinder 30 comprises a housing 32 which is divided into upper and lower chambers 34A and 34B by a diaphragm 36, which is crimped or otherwise sealed along the periphery of housing 32. The center portion of diaphragm 36 is covered by a piston plate 38, which acts as a rigid surface for the pressure in chamber 34A to act upon. In the illustrative embodiment, pneumatic cylinder exerts a force of 4,320 pounds at an inlet pressure of 100 psi with a maximum stroke of 2¾ inches, which corresponds to jaw movement of from an initial gap of ¾ inch to a final gap of 1/16 for jaws having a 1 inch throat. Thus, when used in combination with the toggle linkage as described herein, the pneumatic cylinder provides the force and displacement necessary to crimp virtually all standard structural steel decking in a single-pass operation.

Ram 40 is attached to piston plate 38 in order to convert the pressure action on piston plate 38 and diaphragm 36 into a force for actuating the jaw mechanism as hereinafter described. A return spring 42 acts against the pressure in chamber 34A to return the piston plate 38 to the upper limit of travel when pressure in chamber 34A is equal to the pressure in chamber 34B.

The lower end of ram 40 terminates in a clevis 44 through which passes a clevis pin 46. In addition to passing through clevis 44, clevis pin 46 passes through the upper ends 56, 58 of the input links 50 and 52 of a toggle linkage 60. The lower ends 62 and 64 of input links 50 and 52 are pivotally attached to the upper ends 66 and 68 of jaws 70 and 72. Jaws 70 and 72 are pivotally attached to the lower end of lower extension 20 of frame 12 to open and close in response to the movement of toggle linkage 60. A cross-head slot 48 is provided in lower extension 20. Cross head slot 48 engages clevis pin 46 to constrain clevis pin 46, which comprises the toggle input, to move linearly and therefore, constrains jaws 70 and 72 to move in unison.

A conventional air valve 100 housed within upper extension 18 regulates a source of pressurized air admitted through fitting 104 and provides a pressurized output into hose 106 for admittance into pneumatic cylinder 30. An external valve handle 102 is provided for controlling air valve 100 by the operator. Preferably, a bi-directional valve 120 is operatively disposed between air valve 100 and pneumatic cylinder 30 to admit pressurized air into pneumatic cylinder 30 when air valve 100 is open and to exhaust air from pneumatic cylinder 30 when air valve 100 is closed, thereby allowing pneumatic cylinder 30 to return to its upper limit of travel more rapidly, and thereby increasing the cycle rate of the apparatus.

Figure 4:
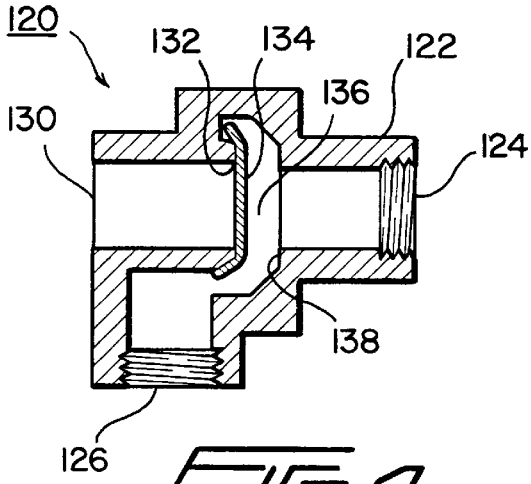
FIG. 4 is a cross section view of a bi-directional valve in accordance with the present invention.

As shown more fully in FIG. 4, bi-directional valve 120 comprises a housing 122 having an inlet 124, which is threaded to receive a standard hose or tube fitting, an outlet 126, which is threaded to form an airtight seal with the inlet 128 (FIG. 2) of pneumatic cylinder 30. Housing 122 further comprises an exhaust port 130. Valve seat 132 is formed on the inner surface of exhaust port 130. A flexible valve member 134 is constrained within chamber 136 of housing 122. As can be seen from FIG. 4, as high pressure air from air valve 100 enters through inlet 124, valve member 134 is forced against valve seat 132 to close off exhaust port 130 and direct the flow of air through outlet 126 into pneumatic cylinder 30. Once air valve 100 is closed, air from pneumatic cylinder 30 begins to reverse direction and enter housing 122 through outlet 126. The reversed flow of air through outlet 126 causes valve member 134 to seat against surface 138 thereby opening exhaust port 130 to permit relatively unobstructed exhaust of pressurized air from pneumatic cylinder 30.

Figure 5:
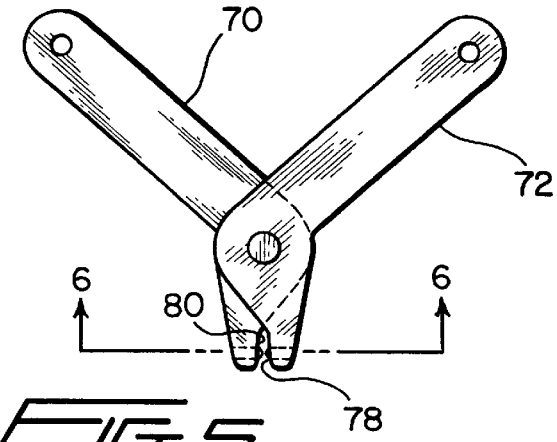
FIG. 5 is a side plan view of the jaws of the apparatus of FIG. 2.
Figure 6:
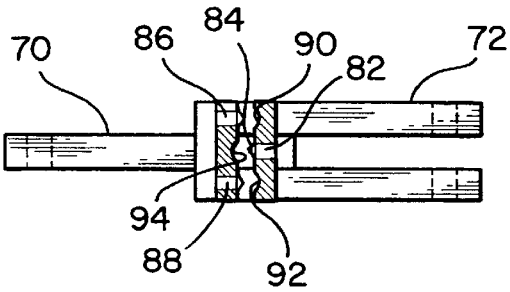
FIG. 6 is a cross section of the jaws of FIG. 5 taken along line 6—6.

With reference to FIGS. 5 and 6, the jaws 70 and 72 are configured to move from an open position, in which the inner surfaces 78 and 80 define an angular opening, to a closed position in which surfaces 78 and 80 define a substantially parallel gap of predetermined thickness, based on the gauge of the decking being crimped. For example for 22 gauge decking, the closed position gap would be set to 1/16 inch.

As shown in FIG. 6, jaw 70 is provided with a single punch 82. Punch 82 is preferably threaded into a corresponding threaded hole in jaw 70, which to permits adjustment of amount by which the exposed tip 84 of punch 82 is proud of the surface 78 of jaw 70. Similarly, jaw 72 is provided with two punches 86 and 88, which are offset to each lateral side (shown as above and below in the side view of FIG. 6) of punch 82. Jaw 72 is provided with dies in the form of indentations 90 and 92 which are juxtaposed from the tips of punches 86 and 88, respectively. Jaw 70 is similarly provided with an indentation 94, which is juxtaposed from the exposed tip 84 of punch 82. Indentations preferably comprise semi-spherical or conical depressions drilled/milled in the surfaces 78 and 80 of jaws 70 and 72. Punches 82, 86 and 88 comprise hardened threaded rods terminating in a conical or spherical tip as are common in the industry.

In operation of a crimping apparatus in accordance with the present invention a user positions jaws 70 and 72 over the seam to be crimped and depresses the valve lever. High pressure air entering pneumatic cylinder 30 causes ram 40 to be forced downward, exerting a force on clevis 44. Toggle linkage 60 actuated by the force on clevis 44 begins its motion from a first position as shown in FIGS. 2 and 3 in which the force multiplication of the toggle linkage is minimum. Toggle linkage 60 is then urged by ram 40 to a second position (not shown) in which the longitudinal axis of links 50 and 52 are collinear and the force multiplication of the toggle linkage theoretically approaches infinity. When used as a crimping tool for closing a male/female seam such as is found in structural steel decking, the toggle linkage employed in the illustrative embodiment provides an ideal force versus displacement curve. At the beginning of the stroke, the crimping tool must overcome only the elastic and then plastic bending resistance of the female lip of the decking along the longitudinal axis of the seam. Therefore less force multiplication is needed at the beginning of the stroke. As the seam closes, however, the crimping tool must plastically deform and upset the combined male and female sections, with concomitant increase in the force that must be applied.

The toggle mechanism of the present invention provides the appropriate nonlinear force multiplication necessary to securely crimp the male and female deck sections together. Moreover, the unique staggered arrangement of punches 82, 86 and 88 and a depressions 90, 92 and 94 which cooperate to form three punch and die sets having alternating orientations, additionally plastically distort the crimped seam to form an arrangement of three dimples in a "Vee" pattern. The three dimples cooperate to prevent lateral shifting of the crimped joint, thereby obviating the need to additionally weld or screw the joint together. A distortion in the decking that would tend to open one of two outside dimples simply tends to tighten the remaining outside dimple, with the center dimple acting as a fulcrum.

The force multiplication of a toggle linkage such as is used in the present invention is highly sensitive to the beginning and ending gap of the jaws 70 and 72. As pivots wear through use, the toggle linkage may begin to go over center before the crimping operation is complete or particularly where lighter gauge metal is used, the crimp may be complete before the linkage approaches its maximum force multiplication, thereby reducing the efficiency of the stroke. Accordingly, means is provided to permit both the input stroke to clevis 44 to be adjusted as well as the linkage ratio of the toggle linkage itself. The input stroke is adjustable by means of a threaded engagement 140 between ram 40 and clevis 44. Similarly the linkage ratio of the toggle linkage 60 is adjustable by means of a threaded engagement 144 between an upper half 144 and a lower half 146 of link 52. Manipulation of the aforementioned adjustments permits the input stroke to be regulated to prevent the toggle linkage 60 from going over center, which could lead to the mechanism becoming jammed, and permits the linkage ratio of the toggle linkage 60 to be adjusted to provide a predetermined gap between the inner surfaces 78 and 80 of jaws 70 and 72 when the toggle linkage 60 is in the on-center position with the axis of links 50 and 52 collinear. The predetermined gap can be adjusted to accommodate the specified crimp thickness of a wide range of standard structural steel decking and roofing panels.

Although certain preferred embodiments and methods have been disclosed herein, it will be apparent from the foregoing disclosure to those skilled in the art that variations and modifications of such embodiments and methods may be made without departing from the spirit and scope of the invention. Accordingly, it is intended that the invention shall be limited only to the extent required by the appended claims and the rules and principles of applicable law.

What is claimed is:

1. A portable crimping apparatus for crimping steel decking to a predetermined crimped thickness said apparatus comprising:

a frame;

a first and second pivoted jaw, each pivotally attached to said frame, each of said first and second pivoted jaws comprising a free end and a driven end, said free ends having opposing surfaces, said surfaces being moveable between a first position in which said surfaces define an angular opening and a second position in which said surfaces define a substantially parallel gap corresponding to said crimped thickness of said steel decking;

a toggle linkage disposed between said driven ends of said first and second pivoted jaws, said toggle linkage comprising a first and second link said first and second links each having first ends, said first ends being pivotally attached one to another to form a toggle input joint, said first link pivotally attached at a second end thereof to said driven end of said first pivoted jaw and said second link pivotally attached at a second end thereof to said driven end of said second pivoted jaw;

a cross head operatively attached to said toggle input joint to constrain said toggle input joint to move linearly, thereby causing said jaws to move in unison;

a pneumatic cylinder;

a connecting rod having an adjustable length operatively disposed between said pneumatic cylinder and said toggle input joint;

said pneumatic cylinder being moveable between a first position in which said toggle linkage urges said jaws into an open position as said toggle linkage moves away from an overcenter position, and a second position in which said toggle linkage urges said jaws into a closed position as said toggle linkage approaches an overcenter condition; and a valve for admitting a flow of pressurized air into said pneumatic cylinder to urge said pneumatic cylinder from said first position to said second position;

said free ends of each of said first and second pivoted jaws each terminating in a plurality of corresponding punch and die sets of alternating orientation, said plurality of corresponding punch and die sets adapted to form a plurality of dimples of alternating direction in said steel decking.

2. A portable crimping apparatus for crimping steel decking to a predetermined crimped thickness, said apparatus comprising:

a frame, a first and second pivoted jaw, each pivotally attached to said frame, each of said first and second pivoted jaws comprising a free end and a driven end, said free ends having opposing surfaces, said surfaces being moveable between a first position in which said surfaces define an angular opening and a second position in which said surfaces define a substantially parallel gap corresponding to said crimped thickness of said steel decking;

a toggle linkage disposed between said driven ends of said first and second pivoted jaws, said toggle linkage comprising a first and second link, said first and second links each having first ends, said first ends being pivotally attached one to another to form a toggle input joint, said first link pivotally attached at a second end thereof to said driven end of said first pivoted jaw and said second link pivotally attached at a second end thereof to said driven end of said second pivoted jaw;

a cross head operatively, attached to said toggle input joint to constrain said toggle input joint to move linearly thereby causing said jaws to move in unison;

a pneumatic cylinder:

a connecting rod having an adjustable length operatively disposed between said pneumatic cylinder and said toggle input joint;

said pneumatic cylinder being moveable between a first position in which said toggle linkage urges said jaws into an open position as said toggle linkage moves away from an overcenter position, and a second position in which said toggle linkage urges said jaws into a closed position as said toggle linkage approaches an overcenter condition;

a valve for admitting a flow of pressurized air into said pneumatic cylinder to urge said pneumatic cylinder from said first position to said second position; and a set of punches and dies disposed in said free ends of said pivoted jaws, said set of punches and dies comprising:

two die formed in said surface of said first jaw and a single punch removably attached to said surface of said first jaw, said single punch disposed between said two die such that said punch is raised above said surface of said first jaw;

two punches removably attached to said surface of said second jaw such that said two punches are raised above said surface of said second jaw, and a single die formed in said surface of said second jaw disposed between said two punches;

said two die being disposed in said first jaw opposite said two punches and said single die being disposed in said second jaw opposite said single punch, said set of punches and dies cooperating to raise three dimples of alternating direction in said steel decking.

3. The apparatus of claim 2, further including an exhaust valve operatively disposed between said air valve and said pneumatic cylinder, said exhaust valve comprising:

a housing having an interior chamber, an inlet, an outlet, and an exhaust port, said exhaust port including a valve seat;

a valve member comprising a flexible disk disposed in said chamber moveable between a first position in which said inlet is open and said exhaust port is sealed and a second position in which said exhaust port is open and said inlet is sealed, said valve member adapted to move to said first position in response to a flow of air through said inlet into said chamber and to move to said second position in response to a flow of air through said outlet into said chamber.

* * * * *